United States Patent [19]

Burgmyer

[11] 4,438,437

[45] Mar. 20, 1984

[54] DUAL MODE BLADE ANTENNA

[75] Inventor: Patricia L. Burgmyer, Great Neck, N.Y.

[73] Assignee: Hazeltine Corporation, Commack, N.Y.

[21] Appl. No.: 301,542

[22] Filed: Sep. 14, 1981

[51] Int. Cl.[3] ..... H01Q 13/16; H01Q 1/28

[52] U.S. Cl. ..... 343/770; 343/853; 343/862; 343/873

[58] Field of Search ..... 343/708, 844, 853, 770, 343/860, 862, 864, 872, 873

[56] References Cited

U.S. PATENT DOCUMENTS

| | | | |
|---|---|---|---|
| 2,831,189 | 4/1958 | Kemper | 343/853 |
| 3,210,764 | 10/1965 | Anderson et al. | 343/708 |
| 3,396,398 | 8/1968 | Dunlavy | 343/844 |
| 3,521,284 | 7/1970 | Shelton et al. | 343/853 |
| 4,015,263 | 3/1977 | Koerner et al. | 343/708 |
| 4,245,222 | 1/1981 | Eng et al. | 343/708 |

*Primary Examiner*—Eli Lieberman

*Attorney, Agent, or Firm*—E. A. Onders; F. R. Agovino

[57] ABSTRACT

A printed circuit board includes first and second antenna elements spaced less than one-quarter wavelength apart and preferably one-eighth wavelength apart. Matching circuitry printed on the circuit board connects the elements to a quadrature coupler. The circuit board is foam encased in a blade-shaped fiberglass radome. The antenna radiates two independent null-free patterns.

6 Claims, 6 Drawing Figures

FIG. 4A
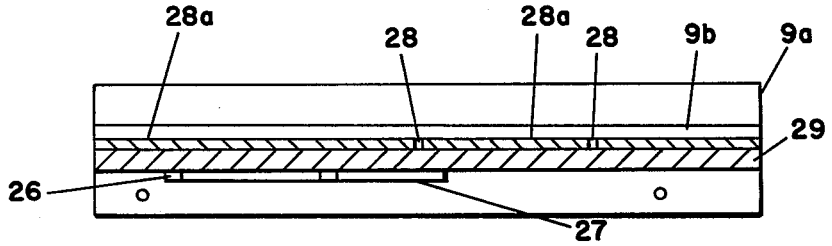
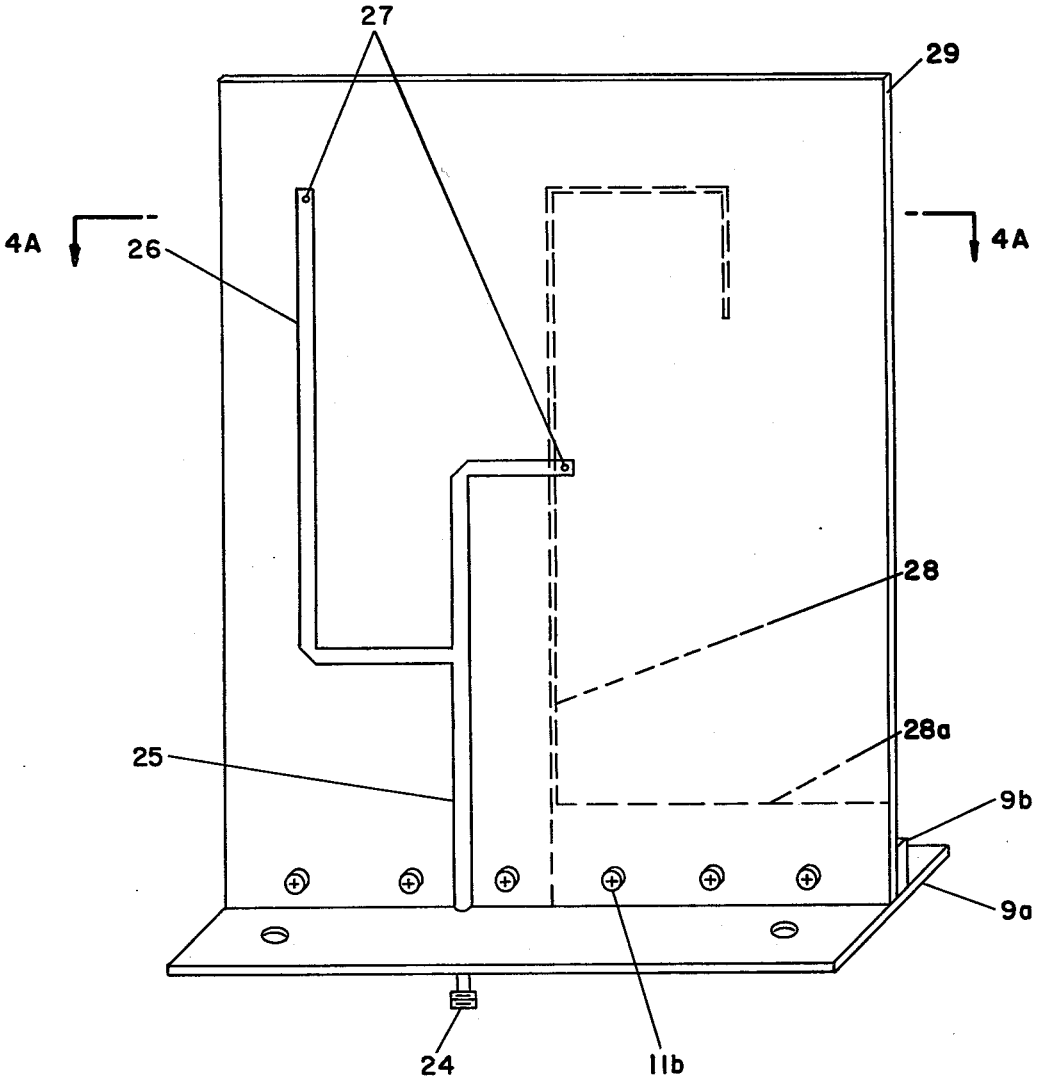
FIG. 4

DUAL MODE BLADE ANTENNA

The Government has rights in the invention pursuant to Contract No. F30602-78-C-0067 awarded by the U.S. Air Force.

BACKGROUND OF THE INVENTION

1. Field of the Invention

The invention generally relates to antennas and, in particular, a dual radiating blade antenna.

2. Background of the Invention

Dual element antennas are commercially available. When the two elements are suitably connected, the antenna patterns are typically two independent cardioids with nulls facing in opposite directions. If two independent null-free patterns are desired, the element spacing would have to be reduced, resulting in severe mutual coupling effects.

SUMMARY OF THE INVENTION

The invention comprises an antenna for radiating signals of a given wavelength. A first radiating means is spaced less than one-quarter of the given wavelength from a second radiating means. The invention further includes means for feeding in-phase and quadrature conponents of the signal to said first and second radiating means and a blade-shaped radome enclosing said first and second means. This results in the combined first and second means radiating two independent, nondirectional patterns when the signal is applied thereto.

It is an object of this invention to provide a dual-mode blade antenna radiating two independent, nondirectional patterns.

It is a further object of this invention to provide an antenna having two elements spaced apart less than one-quarter of the wavelength of a signal to be applied thereto.

For a better understanding of the present invention, together with other and further objects, reference is made to the following description, taken in conjunction with the accompanying drawings, and its scope will be pointed out in the appended claims.

BRIEF DESCRIPTION OF THE DRAWINGS

FIG. 4 illustrates an alternative embodiment of a folded monopole radiator printed on a circuit board and mounted on a base plate.

FIG. 4A is a cross sectional view taken along lines 4A—4A of FIG. 4.

DETAILED DESCRIPTION OF THE INVENTION

Figure 1:
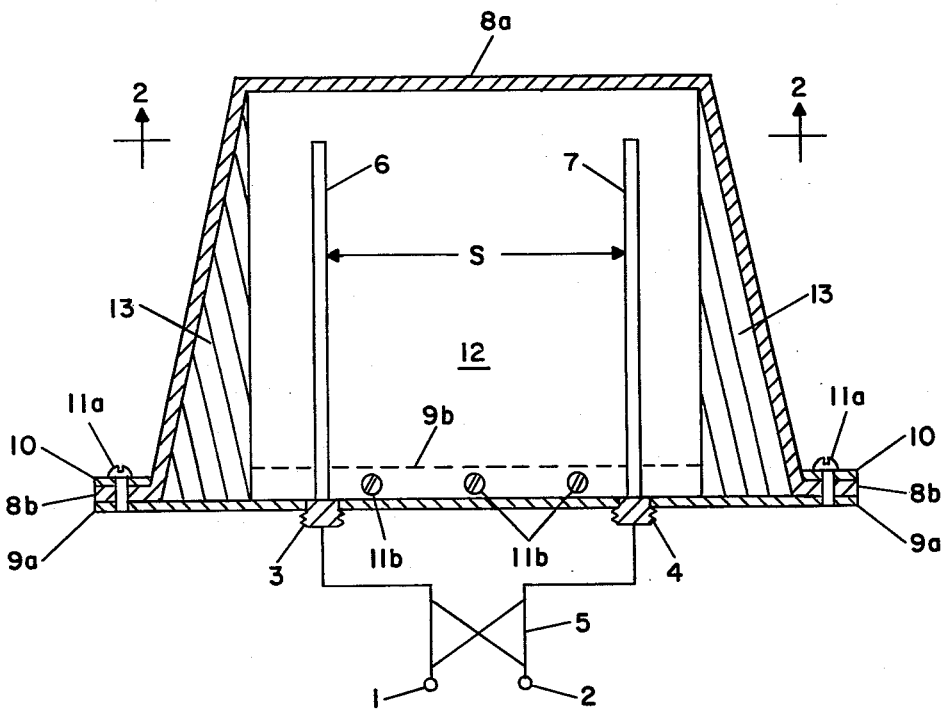
FIG. 1 is a longitudinal, sectional view showing a dual mode blade antenna according to the invention.

FIG. 1 illustrates a dual mode blade antenna according to the invention. Antenna pattern ports 1 and 2 feed element radiator ports 3 and 4, which may be coaxial connectors to a quadrature coupler 5 so that signals applied to antenna pattern ports 1 and 2 excite element radiators 6 and 7. Coupler 5 may be any conventional 3dB quadrature coupler which provides an equal amplitude split with a quadrature phase relationship from its two output ports when either input port is fed. In a preferred embodiment, radiators 6 and 7 may be printed radiator elements on printed circuit board 12 and spaced by a distance S. The printed circuit board 12 is supported by base 9*a* which includes a perpendicular mounting member 9*b* to which printed circuit board 12 is connected by screws 11*b*. Printed circuit board 12 is enclosed in blade shaped radome 8*a* which is filled with insulating foam 13. The edges of radome 8*a* terminate in flange 8*b* which is engaged by mounting plate 10 and firmly affixed to base plate 9*a* by screws 11*a*.

In operation, null-free (i.e., nondirectional) patterns are obtained when each of the antenna pattern ports (input coupler ports) 1, 2 is fed with a signal having a given wavelength such that the radiators are spaced less than one-quarter of the given wavelength apart. The direction of maximum signal radiation is opposite for the antenna pattern ports 1, 2.

Figure 2:
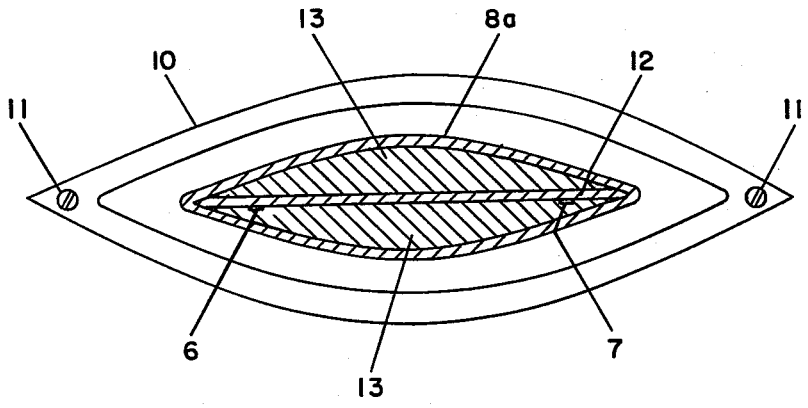
FIG. 2 is a sectional view taken along lines 2—2 of FIG. 1.
Figure 3:
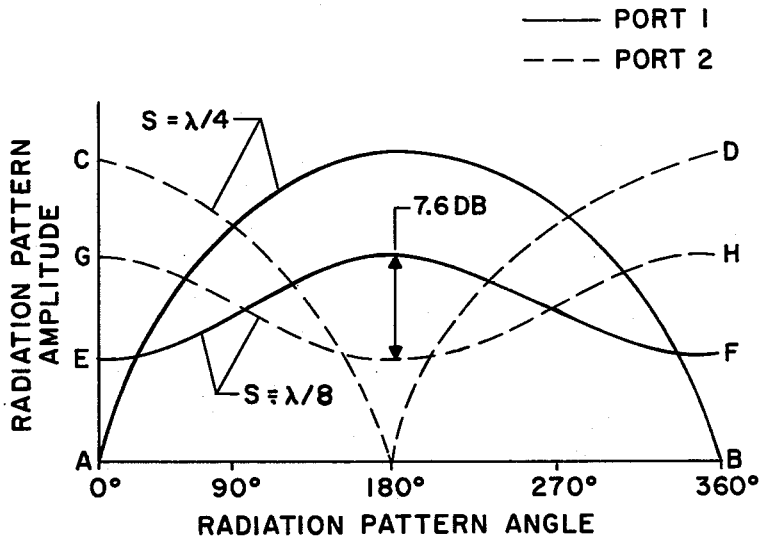
FIG. 3 illustrates typical patterns of a two-radiator antenna fed in quadrature when the radiating elements are spaced apart at one-eighth wavelength and one-quarter wavelength.

The pattern of a two-radiator antenna fed in quadrature as illustrated in FIGS. 1 and 2, is a function of the element spacings. The pattern varies from omnidirectional for very close spacing to a pattern with an infinite front to back ratio (cardioid) at a quarter-wave spacing. Typical radiating patterns for such spacings are shown in FIG. 3. Line AB illustrates an antenna radiation pattern resulting from feeding the first pattern port of a quadrature fed two-element antenna with the elements spaced one-quarter wavelength apart. Line CD illustrates an antenna radiation pattern resulting from feeding the second pattern port of a quadrature fed two-element antenna with the elements spaced one-quarter wavelength apart. Patterns AB and CD have nulls in opposite directions. Line EF illustrates an antenna radiation pattern resulting from feeding the first pattern port of a two-element quadrature fed antenna with the elements spaced one-eighth wavelength apart. Line GH illustrates an antenna radiation pattern resulting from feeding the second pattern port of a two-element quadrature fed antenna with the elements spaced one-eighth wavelength apart. Patterns EF and GH are null-free. By reciprocity, similar patterns are obtained in reception.

The antenna according to the invention is suitable for aircraft installation in that it is mechanically rigid with a low wind resistance, impervious to severe environmental extremes and capable of absorbing a lightning strike without burning out a receiver connected thereto. The mechanical restrictions are fulfilled by a blade-type design. The lightning requirement is met by a grounded antenna providing a shunted low resistance path for the lightning to bypass the receiver. Standard monopoles or folded dipole elements may be employed as radiators. The feed of each folded monopole may be DC grounded, satisfying the lightning requirement.

A preferred embodiment of a double-sided printed circuit implementation of the folded monopole element for use as one of the two radiating elements of an antenna according to the invention is illustrated in FIGS. 4 and 4A. This double-sided printed circuit configuration provides a microstrip transmission line on the front of board 29 which is used to connect coaxial input 24 (the element port) to the feed point. As indicated by the dotted lines, folded monopole 28*a* defining slot 28 is on the back of board 29. Microstrip feed line 25 includes tuning stubs 26 which terminate in feed-through ports 27 associated with a quarter-wave slot 28 defined by folded monopole 28*a*. Screws 11*b* connect printed circuit board 29 to mounting member 9*b*.

Figure 5:
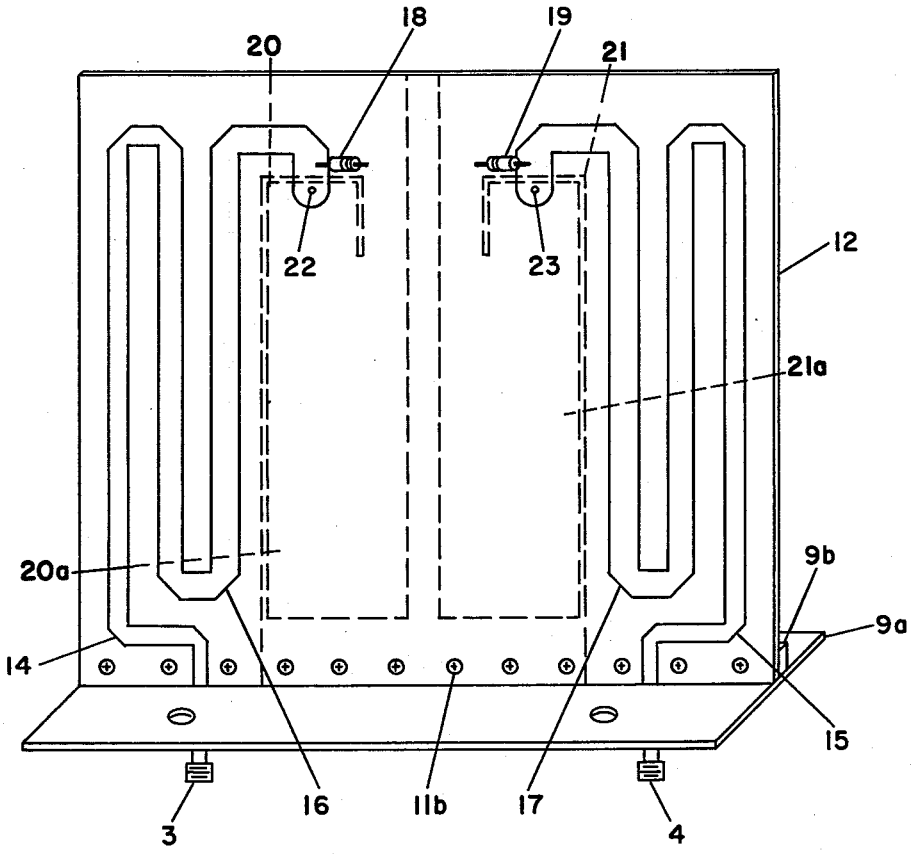
FIG. 5 illustrates a printed circuit board having two folded monopole radiators printed thereon and mounted to a base plate.

FIG. 5 illustrates an embodiment of two dual mode antenna elements according to the invention. In this embodiment, element ports 3 and 4 are illustrated as coaxial connectors which are coupled to microstrip feed lines 14 and 15 on the front of board 12. Each of these feed lines includes a three section Tchebyscheff transformer 16, 17 terminating in feed-through resistors 18, 19 and feed-through ports 22, 23. Printed circuit board 12 is attached to base plate 9*a* by screws 11*b* engaging mounting member 9*b*. Microstrip feed lines 14 and 15 are coupled to slot lines 20 and 21 defined by folded monopoles 20*a* and 21*a*, respectively on the back of board 12.

For the antennas illustrated in FIGS. 4 and 5, the monopoles may be any conventional radiator known in the prior art such as a folded strip having a narrow slot therebetween. This type of transmission medium, known as slot line, may be triple tuned to obtain a VSWR of less than 2:1 over greater than an octave frequency band.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An antenna for radiating a signal of given wavelength comprising:

(a) a printed circuit board having first and second opposing sides;

(b) first and second folded slat monopoles on the first side of said board and spaced apart by less than one-quarter of the given wavelength;

(c) first and second microstrip feed lines on the second side of said board, said first line terminating in a first radiator port associated with said first monopole and said second line terminating in a second radiator port associated with said second monopole; and (d) means for applying in-phase and quadrature components of the signal to said first and second lines, respectively.

2. The antenna of claim 1 wherein each said microstrip feed line includes a Tchebyscheff transformer connected to a terminating resistor.

3. The antenna of claim 2 wherein said monopoles are spaced apart, center-to-center, by an amount equal to one-eighth of the given wavelength.

4. The antenna of claim 1 wherein said means for applying comprises a quadrature coupler having a first input port, a second input port, an in-phase output port associated with said first line and a quadrature output port associated with said second line whereby said first and second monopoles in combination radiate a first pattern when the signal is applied to said first input port and said first and second monopoles in combination radiate a second pattern, independent of said first pattern, when the signal is applied to said second input port.

5. The antenna of claim 4 wherein said board is enclosed in a blade shaped fiberglass radome containing foam.

6. The antenna of claim 1 wherein said board is enclosed in a blade shaped radome.

* * * * *